United States Patent [19]

Schaefer

[11] 4,333,647

[45] Jun. 8, 1982

[54] ARM CONTROL DEVICE FOR ATHLETE

[76] Inventor: William J. Schaefer, 3706 Jay La. South, Rolling Meadows, Ill. 60008

[21] Appl. No.: 142,672

[22] Filed: Apr. 22, 1980

[51] Int. Cl.[3] ..... A63B 69/00

[52] U.S. Cl. ..... 273/54 B; 273/29 A; 273/189 A

[58] Field of Search ..... 273/54 B, 189 R, 189 A, 273/29 A, 29 R; 128/89 R

[56] References Cited

U.S. PATENT DOCUMENTS

| | | | |
|---|---|---|---|
| 3,036,831 | 5/1962 | Engan | 273/54 B |
| 3,099,448 | 7/1963 | Salvo et al. | 273/54 B |
| 3,829,090 | 8/1974 | Ensinger | 273/54 B |
| 3,970,305 | 7/1976 | Hawkins | 273/54 B |
| 4,191,373 | 3/1980 | Lancellotti | 273/29 A |

*Primary Examiner*—Anton O. Oechsle

[57] ABSTRACT

An athletic hand movement restricting device intended for attachment to the forearm and wrist of a bowler. The intent of the device is to restrict the said bowler's hand from rotating inwardly over on top of the bowling ball into an undesireable release position, and when the said device is secured into position on the said bowler's forearm and wrist, the said device restricts the said bowler's hand from rotating inwardly past a preselected position, but will allow a full unrestricted rotation of the said bowler's hand in an outwardly direction. The amount of restriction can be increased by the said bowler, previous to the said bowler's turn to play, through the use of a movable adjustment means. The said bowler's wrist is free to flex in all four planes while the said device is in position and while the said device is in use. The said device comprises two adjustable means; a wrist means and a forearm means, which secure a hinged plate assembly to the said bowler's forearm and wrist in a manner that will allow the said bowler's hand to rotate outwardly to an open position, but the said device will restrict the said bowler's hand from rotating inwardly into an incorrect closed position before the release of the said bowling ball.

7 Claims, 6 Drawing Figures

FIG. 1
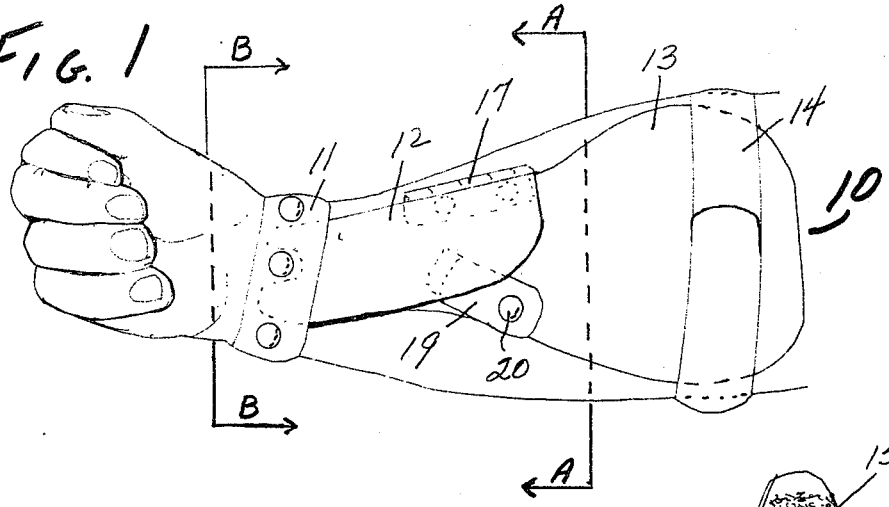
FIG. 2
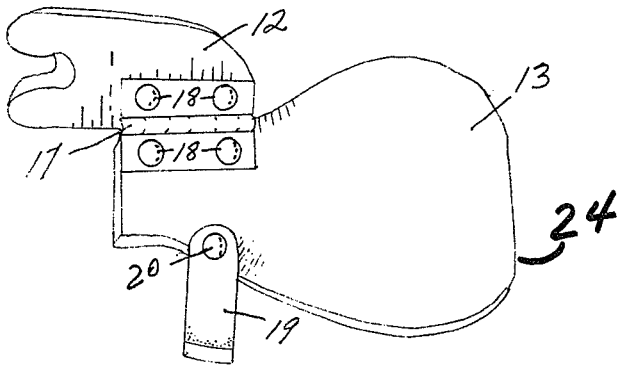
FIG. 3
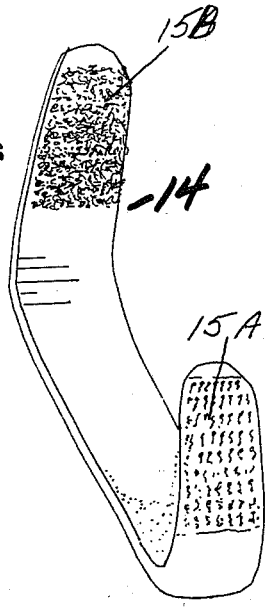
FIG. 4
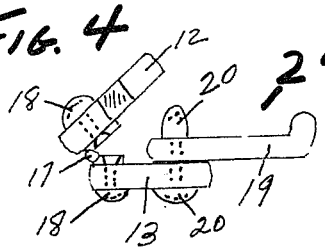
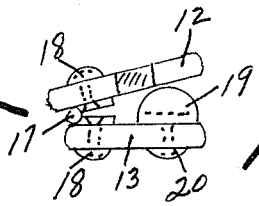
FIG. 5
FIG. 6
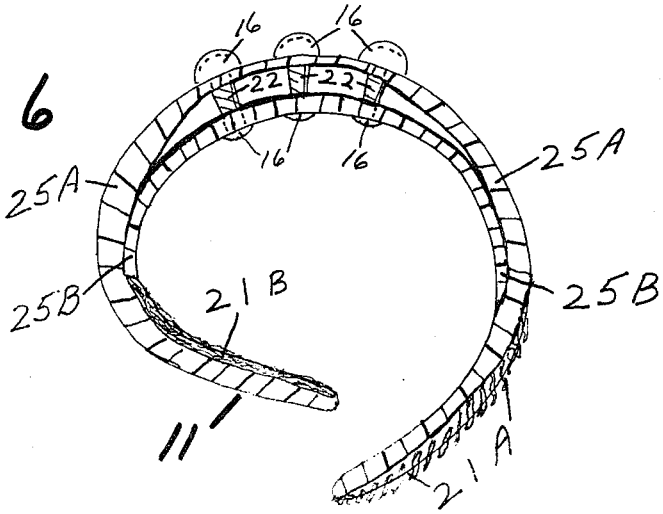

ARM CONTROL DEVICE FOR ATHLETE

BACKGROUND OF THE INVENTION

This invention relates to an athletic device and more particularly to a device to be used in the sport of bowling to assist a bowler to maintain the proper hand position so as to release the bowling ball in the most favorable manner. In the sport of bowling, it is desirable to restrict the said bowler's hand from rotating inwardly over on top of the said bowling ball before release of the said bowling ball, and so one of the fundamental rules of bowling is that the said bowler must be able to feel his hand position at the release of the said bowling ball and the most commonly used method to guage or feel the hand position is one in which the position of the thumb in the said bowling ball is envisioned by the use of an imaginary clock, which is maintained in the said bowler's mind throughout the entire swing and approach and the subsequent delivery or release of the said bowling ball.

The said imaginary clock is impressed on the said bowler's mind in the following manner; assuming the said bowler is a right-handed bowler, the said bowler allows the right arm to hang straight down at the side of the said bowler's body, then rotates the right hand so the thumb of the said right hand points directly forward. The said bowler's right hand is now in the 12:00 o'clock position, and any rotation of the said right hand in an outward, clockwise direction will make the said thumb go forward on the imaginary clock to 1:00 o'clock or 2:00 o'clock, or even to 3:00 o'clock, depending on how far the said right hand and thumb are rotated. If the said right hand and thumb are rotated in a counter-clockwise direction, the imaginary clock goes backward to 10:00 o'clock, or 9:00 o'clock, or even to 7:00 o'clock, depending on how far the said right hand and thumb are rotated.

In the event the said bowler is a left-handed bowler, the imaginary clock would be used in reversed manner, because when a left-handed bowler rotates the left hand in an outward direction, the said left hand rotates in a counterclockwise direction. However, to avoid confusion to the reader, all further references to the said imaginary clock will apply to a right-handed bowler.

The proper bowling ball release for either a "hooking" ball or a "curving" ball for a right-handed bowler can be achieved only by having the right thumb, at the release of the said bowling ball, in a position somewhere between 7:00 o'clock and 11:00 o'clock, as shown on the said imaginary clock.

In the prior art, athletic devices to restrict the bowling hand from rotating inwardly over on top of the bowling ball before release have been proposed, however, those known all have certain disadvantages, and there are some previous devices which have attempted to completely immobilize the bowler's hand or wrist to achieve this purpose. However, there are certain types of bowling ball release which cannot be utilized unless the bowler's hand and wrist are free to rotate outwardly during the swing of the said bowling ball.

SUMMARY OF THE INVENTION

It is therefore the object of this present invention to provide a device which allows a bowler's hand to rotate outwardly with no restriction, but which will restrict the said bowler's hand from rotating inwardly over on top of the bowling ball to an unfavorable bowling hand position before release of the said bowling ball. The following description assumes the hand and thumb move as a unit.

The manner in which this present device restricts the rotation of the said bowler's hand is best described in the following manner; a bowler (or another interested person) should allow the bowling arm to hang straight down as described previously in the mental impression of the imaginary clock. Using the imaginary clock, the said bowler should place the thumb of the bowling hand in the 12:00 o'clock position, and while pressing the bowling arm elbow firmly against the side of the said bowler's body so the said elbow cannot rotate, the said bowler should rotate the said thumb outward in a clockwise direction as far as the said thumb can rotate in an outwardly direction. Normally this outward rotation will take the said thumb to about the 2:00 o'clock position. Then, the said bowler should rotate the said thumb inwardly in a counter-clock wise direction as far as the said thumb can rotate while still not allowing the said bowling arm elbow to rotate. Normally this inward rotation will take the said thumb to about the 6:00 o'clock position, which is much further than the amount of rotation necessary or desireable to roll the bowling ball with the proper amount of "hooking" or "curving" action. As a matter of fact, rotating the bowling hand and the thumb to this 6:00 o'clock position before the bowling ball is released, will not only "kill" the hook, but in most cases, will pull the said bowling ball to the left of the line the said right-handed bowler desires the said bowling ball to roll on.

This present device will restrict the bowler's hand and thumb from rotating inwardly past the 7:00 o'clock position, and if the said bowler chooses to use the movable fulcrum feature of this present device, this present device, when in position on the arm of the said bowler, will restrict the inward rotation of the said bowler's hand and thumb to 8:00 o'clock, or 9:00 o'clock, or even to 11:00 o'clock, depending on what position the said movable fulcrum is placed in by the said bowler. The restrictive action of this present device can best be understood by again placing the bowling arm elbow in the fixed non-rotatable elbow position described previously, then placing the bowling hand and thumb in the 12:00 o'clock position on the imaginary clock. The bowler (or another interested person) should take a mental note of the position of the flat portion on the upper inside surface of the said bowler's forearm when the said bowler's bowling hand and thumb are in the 12:00 o'clock position on the imaginary clock. The said bowler rotates the bowling hand and thumb inwardly in a counter-clock wise direction as far as the said hand will rotate, (approximately one hundred and eighty degrees), to about 6:00 o'clock, and the said bowler should again take note of the position of the said flat portion on the upper inside surface of the said bowler's forearm, which will be seen to have rotated only about thirty to forty degrees. It is now apparent that if the said bowler's bowling hand and thumb rotation inwardly could somehow be restricted, it would be of great value to the "stroke" or release of the bowling ball by the said bowler. It is also now apparent that the said bowling hand and thumb restriction could be achieved by some sort of attachment from the said flat portion on the upper inside surface of the said bowler's forearm to the inside of the said bowler's wrist, since it is impossible for one's hand to rotate without a matching rotation of the attached wrist.

This present device does restrict the bowler's wrist and hand and thumb from rotating too far inwardly in a counter-clockwise direction before the release of the bowling ball, and does that said restriction very efficiently in a working model constructed for testing.

Another object of this present invention is that the bowler who uses the "turn and lift" bowling ball release is able to utilize this present device as this present device allows the said bowler's wrist and hand and thumb to rotate outwardly in a clockwise direction freely with no restriction at all, and this said bowler who utilizes the "turn and lift" bowling ball release receives an added benefit from this present device, in that the said "turn and lift" bowler is able to turn very strongly into the "lift" position with no worries about "overturning" the ball before release, as this present device will restrict the said bowler's wrist and hand and thumb inward rotation at any position pre-selected by the said bowler, before the said bowler's turn of play, through the use of the said movable fulcrum feature.

Another object of this present invention is to enable a bowler to change the "hooking" action of the said bowler's ball, at will, since the amount of "hook" or "break" can be increased or decreased or can even be almost completely eliminated, if desired, simply by movement of the said movable fulcrum by action of the said bowler.

It is a further object of this present invention to provide a unique and simple, effective, and economical hand movement restricting device to assist a bowler to maintain the proper hand position so as to release the bowling ball in the most favorable manner.

In one embodiment, this present device comprises forearm means to be secured to the forearm just below the elbow, and wrist means to be secured to the wrist just above the hand.

In an attempt to simplify terminology, henceforth the said forearm means shall be known as the forearm cuff means, and the said wrist means shall be known as wrist cuff means. In this said embodiment of this present device, the forearm cuff means and the wrist cuff means are both adjusted to the size of the user's forearm and wrist and to secure a hinged plate assembly to the inside of the said user's upper forearm just below the elbow and to the inside of the said user's wrist just above the hand. The hinged plate assembly comprises a wrist plate means which is secured to the inside of the said user's wrist by insertion into a pocket in the said wrist cuff means after the said wrist cuff means has been comfortably adjusted and secured to the wrist of the said user by suitable attaching means, and the said hinged plate assembly further comprises a forearm plate means which is secured to the inside of the said user's upper forearm just below the elbow by the said forearm cuff means, which is adjusted to snugly fit the largest part of the said user's forearm by suitable attaching means, and is then placed into position by the said user by placing the said user's hand through the circular opening formed by the adjustment of the said forearm cuff means, and then by sliding the said forearm cuff means over the said hand, over the said wrist cuff means, over the inserted said wrist plate means, and finally onto the said forearm plate means to a point just below the said user's elbow, at which point the said forearm plate means is secured firmly against the upper inside of the said user's forearm by the said forearm cuff means. The said hinged plate assembly further comprises a hinge means which allows the said wrist plate means and the said forearm plate means to move in two different axes, and said movement is restricted in one direction by the motion of the said hinge means when the said hinge means attains a fully closed position. The said hinge means can be adjustably restricted before attaining a fully closed position by a movable fulcrum means which is movably secured to the said forearm plate means by suitable attaching means, and said forearm plate means is attached by suitable means to the lower or inner leaf of said hinge means to become an extension of the lower or inner leaf of said hinge means and therefore the lower portion of the said forearm plate means extends under the upper portion of the said wrist plate means which is attached by suitable means to the upper or outer leaf of said hinge means to become an extension of the upper or outer leaf of said hinge means and therefore the upper portion of the said wrist plate means extends over the lower portion of the said forearm plate means. The overlap of the said forearm plate means and the said wrist plate means allows restriction of the movement of the said wrist plate means by rotation of the said movable fulcrum means, and this said restriction can be controlled by rotation of the said movable fulcrum to any position the said user desires, simply by rotating the said movable fulcrum means to a different position under the said wrist plate means.

In another embodiment of this present device, the complete device can be worn on the outside of the forearm (with minor adjustments) in the event that the user has some reason for not wearing this present device on the inside of the forearm, and when worn in this manner, this present device will still restrict the inward movement of the bowling hand, but in this embodiment, the said device will have a tendency to change position on the said user's arm, since the outside of the forearm is basically round, rather than flat as is the upper inside of the forearm.

In still another embodiment of this present device, should the user desire to restrict the outward rotation of the bowling hand, rather than restrict the inward rotation of the bowling hand as disclosed in a previous embodiment, this desired change could be made by simply reversing the hinged action of the hinged plate assembly and by wearing the said device on either side of the forearm as the said user desires.

Many other embodiments of this present device are possible, and by way of example, these possibilities are set forth;

the hinged plate assembly would be replaced by a single, solid plate of similar size and shape to be secured to both the wrist cuff means and the forearm cuff means by any of the means set forth in previous embodiments, and this possibility would restrict a bowler's hand from rotating inwardly over on top of the bowling ball before release of the said bowling ball, but this present possibility would not have the adjustment feature of the embodiment disclosed.

Other objects, advantages and novel features of the present invention will become apparent from the following detailed description of the present invention when considered in conjunction with the accompanying drawings.

BRIEF DESCRIPTION OF THE DRAWINGS

FIG. 1 is a side elevational view of the athletic hand movement restricting device attached securely to the inside of a right handed bowler's wrist and forearm.

FIG. 2 is a top view of the hinged plate assembly with wrist cuff means and forearm cuff means removed and with said hinged plate assembly in a fully opened position to show the hinge means and the movable fulcrum means.

FIG. 3 is a partially opened view of the forearm cuff means.

FIG. 4 is an end view of the hinged plate assembly shown as viewed in the direction of line B—B of FIG. 1 with the movable fulcrum shown fully inoperative.

FIG. 5 is an end view of the hinged plate assembly shown in a partially open position through manual adjustment of the movable fulcrum means as viewed in the direction of line B—B of FIG. 1.

FIG. 6 is an end view of the wrist cuff means riveted pocket detail as viewed in the direction of line A—A of FIG. 1.

DETAILED DESCRIPTION OF THE INVENTION

Referring now to the drawings wherein like reference characters refer to like and corresponding parts throughout the several views, the athletic hand movement restricting device 10 is shown attached securely to the inside of a right-handed bowler's wrist and forearm in FIG. 1. The parts of the device as shown in FIG. 1 are wrist cuff 11, forearm cuff 14, wrist plate 12, forearm plate 13, and movable fulcrum 19, and said movable fulcrum 19, together with wrist plate 12 and forearm plate 13 comprise the exposed parts of hinged plate assembly 24 as shown in FIG. 1.

FIG. 2 is a view of hinged plate assembly 24 fully opened to show wrist plate 12 attached to upper, outer leaf of hinge 17 by means of rivets 18, and FIG. 2 also shows forearm plate 13 attached to lower, inner leaf of hinge 17 by means of rivets 18, and FIG. 2 further shows movable fulcrum 19 attached to forearm plate 13 by means of a rivet 20. Wrist plate 12, forearm plate 13, and movable fulcrum 19 are formed from a flat material, such as plastic, or another similar material, and no end view to indicate the thickness of these said parts is shown.

FIG. 3 is a partially opened view of forearm cuff 14 with hook fasteners 15A and loop fasteners 15B, identified by the trademark VELCRO, attached to forearm cuff 14 to allow said forearm cuff 14 to be adjustably secured to user's forearm. The forearm cuff 14, as shown in FIG. 3, and the wrist cuff 11, as shown in FIG. 6, are both fabricated from a strong, flexible material such as leather, or another similar material.

FIG. 4 is an end view of hinged, plate assembly 24 as viewed in the direction of line B—B of FIG. 1, showing upper, outer leaf of hinge 17 attached by rivets 18 to wrist plate 12 and lower, inner leaf of hinge 17 attached by rivets 18 to forearm plate 13 with movable fulcrum 19 attached by a rivet 20 to forearm plate 13. In FIG. 4, said movable fulcrum 19 is shown fully inoperative to allow hinge 17 to close as far as possible.

FIG. 5 is an end view of hinged plate assembly 24 shown partially opened, as viewed in the direction of line B—B of FIG. 1, showing upper, outer leaf of hinge 17 attached by rivets 18 to wrist plate 12 and lower, inner leaf of hinge 17 attached by rivets 18 to forearm plate 13 with movable fulcrum 19 attached by a rivet 20 to forearm plate 13. In FIG. 5, movable fulcrum 19 is shown rotated into an adjustment that will restrict hinge 17 in a partially open position. As shown in FIG. 2, wrist plate 12 is secured to upper, outer leaf of hinge 17 by means of rivets 18 and becomes an integral extension of the upper, outer leaf of hinge 17, so any restriction to the movement of wrist plate 12 is a restriction to the movement of hinge 17, and any restriction to the movement of hinge 17 is a restriction to the movement of wrist plate 12.

FIG. 6 is an end view of wrist cuff 11, as viewed in the direction of the line A—A of FIG. 1, showing how pocket is formed by rivets 16 passing through outer band 25A, spacers 22 and inner band 25B to create a pocket in wrist cuff 11 to allow the notched end of wrist plate 12, as shown in FIG. 2, to slide into wrist cuff 11, as shown in FIG. 1. FIG. 6 further shows the outer band 25A, which is made and fabricated of leather or other similar material, partially opened, and FIG. 6 further shows hook fasteners 21A and loop fasteners 21B, identified by the trademark VELCRO, attached to the two ends of outer band 25A to allow the two ends of outer band 25A of wrist cuff 11 to be adjusted and securely attached around user's wrist.

While I have described and set forth the principles of my invention in connection with a number of specific embodiments, it is to be clearly understood that this description is only by way of example and is not to be considered a limitation to the scope of my invention as set forth in the accompanying claims, as I feel this invention has a definite value in other sports, such as golf, tennis, etc.

What is claimed is:

1. An athletic hand movement restricting device comprising:

hinged plate assembly means for connecting a user's forearm and wrist;

said hinged plate assembly means including forearm means to be secured to a user's forearm just below the elbow and wrist means to be secured to a user's wrist;

means for securing said forearm means to a user's forearm just below the elbow;

means for securing said wrist means to a user's wrist;

said hinged plate assembly means being so constructed as to allow unrestricted relation of the user's wrist, hand and thumb about an axis passing through the forearm and wrist in a direction away from the body while restricting rotation beyond a predetermined point in the opposite direction.

2. The athletic hand movement restricting device of claim 1 wherein:

said hinged plate assembly means for connecting a user's forearm and wrist comprises:

hinge means having first and second members hinged together by a pivot means;

said first member being secured to a forearm plate means;

said second member being secured to a wrist plate means;

said forearm plate means to be secured to the inside of one's forearm just below one's elbow by the said forearm means and said forearm plate means extends downwardly toward one's wrist and the lower portion of said forearm plate means lies under the upper portion of said wrist plate means, when the said device is viewed secured in usable position on the wrist and forearm of a user;

said wrist plate means to be secured to the inside of one's wrist by the said wrist means and said wrist plate means extends upwardly toward one's elbow and the upper portion of said wrist plate means lies over the lower portion of said forearm plate means, when the said device is viewed secured in usable position on the wrist and forearm of a user;

movable fulcrum means secured to the said forearm plate means in a manner which allows said movable fulcrum to pivot on the said forearm plate means in any direction to a predetermined position desired by a user.

3. The athletic hand movement restricting device of claim 2 wherein:

said movable fulcrum means secured to the said forearm plate means in a manner which allows said movable fulcrum to pivot on the said forearm plate means in any direction to a predetermined position desired by a user comprises:

lever means in the form of a right angle;

said lever means being secured to said forearm plate means of said hinged plate assembly means by attaching means which allow said lever means to pivot either outwardly or inwardly on the said forearm plate means;

said pivoting movement of said lever means is manually controlled by a user preceeding said user's turn of play and said movement depends on desired result that said user wants to achieve;

said attaching means securing said lever means to said forearm plate means to be in the form of a rivet;

said pivoting movement of said lever means causes the said fulcrum action of the said lever means to increase the angularity of the said wrist plate means in relation to the said forearm plate means when the said lever means is pivoted inwardly under the said wrist plate means by the said user before the said user's turn of play;

said pivoting movement of said lever means causes the said fulcrum action of the said lever means to decrease the angularity of the said wrist plate means in relation to the said forearm plate means when the said lever means is pivoted outwardly under the said wrist plate means by the said user before the said user's turn of play;

said lever means can be pivoted outwardly by the said user to a position in which the said lever means is no longer in a position under the said wrist plate means and the said hinge means of the said hinged plate assembly means can be closed as far as possible.

4. The athletic hand movement restricting device of claim 1 wherein:

said hinged plate assembly means including forearm means to be secured to a user's forearm just below the elbow and wrist means to be secured to a user's wrist comprises:

said forearm means comprises a strong flexible band or cuff of sufficient length to encircle the forearm of a user and to allow one end of the said band means to overlap the opposite end of the said band means;

said wrist means comprises a strong flexible band or cuff of sufficient length to encircle the wrist of the said user and to allow one end of the said band means to overlap the opposite end of the said band means.

5. The athletic hand movement restricting device of claim 1 wherein:

means for securing said forearm means to a user's forearm just below the elbow comprises:

said forearm means comprises a band means of a strong flexible material of sufficient length to encircle the forearm of a user and to allow one end of said band means to overlap the opposite end of the said band means;

said band means overlap to be of sufficient length to secure hook fasteners to said overlapping end of said band means and also to be of additional sufficient length to secure loop fasteners to underlapping opposite end of said band means to allow a user to adjust said band means to exact size of said user's forearm and to fasten securely.

6. The athletic hand movement restricting device of claim 1 wherein:

means for securing said wrist means to a user's wrist comprises:

said wrist means comprises a band means of a strong flexible material of sufficient length to encircle the wrist of a user and to allow one end of the said band means to overlap the opposite end of the said band means;

said band means overlap to be of sufficient length to secure hook fasteners to the said overlapping end of the said band means and also to be of additional sufficient length to secure loop fasteners to underlapping opposite end of said band means to allow a user to adjust said band means to exact size of said user's wrist and to fasten securely.

7. The athletic hand movement restricting device of claim 1 wherein:

said hinged plate assembly means being so constructed as to allow unrestricted rotation of the user's wrist, hand and thumb about an axis passing through the forearm and wrist in a direction away from the body while restricting rotation beyond a predetermined point in the opposite direction comprises:

means to secure said hinged plate assembly means to the forearm of a user;

means to secure said hinged plate assembly means to the wrist of a user;

said means for securing said hinged plate assembly means to the forearm of a user comprises a tightly fitting adjustment of the said forearm means to the exact size of a user's forearm so that when the said forearm means is placed in position on the said user's forearm just below the elbow, the said forearm means will securely hold the said hinged plate assembly means firmly in position on the said user's forearm;

said means for securing said hinged plate assembly means to the wrist of a user comprises a pocket fabricated into the said wrist means into which said pocket the notched end of the wrist plate means of the said hinged plate assembly means is inserted.

* * * * *